US008659483B2

(12) United States Patent
Ridgeway

(10) Patent No.: US 8,659,483 B2
(45) Date of Patent: Feb. 25, 2014

(54) BALANCED DUAL-BAND EMBEDDED ANTENNA

(75) Inventor: Robert Wayne Ridgeway, Saratoga Springs, UT (US)

(73) Assignee: Digi International Inc., Minnetonka, MN (US)

( * ) Notice: Subject to any disclaimer, the term of this patent is extended or adjusted under 35 U.S.C. 154(b) by 142 days.

(21) Appl. No.: 13/408,858

(22) Filed: Feb. 29, 2012

(65) Prior Publication Data

US 2013/0222188 A1 Aug. 29, 2013

(51) Int. Cl.
*H01Q 1/38* (2006.01)

(52) U.S. Cl.
USPC ..... 343/700 MS; 343/795

(58) Field of Classification Search
USPC ..... 343/700 MS, 795, 846, 848
See application file for complete search history.

(56) References Cited

U.S. PATENT DOCUMENTS

| | | | | |
|---|---|---|---|---|
| 4,825,220 | A | 4/1989 | Edward et al. | |
| 6,642,903 | B2 * | 11/2003 | Schantz | 343/795 |
| 7,129,904 | B2 * | 10/2006 | Chen | 343/795 |
| 7,158,089 | B2 * | 1/2007 | Mohammadian et al. | 343/795 |
| 8,170,498 | B2 * | 5/2012 | Rofougaran | 455/73 |
| 2004/0217912 | A1 * | 11/2004 | Mohammadian | 343/795 |
| 2008/0150823 | A1 * | 6/2008 | Mohammadian et al. | 343/795 |

* cited by examiner

*Primary Examiner* — Hoanganh Le
(74) *Attorney, Agent, or Firm* — Fogg & Powers LLC

(57) ABSTRACT

A planar antenna, such as included as a portion of a printed circuit board (PCB) assembly, can include a dielectric layer and a first conductive layer mechanically coupled to the dielectric layer. In an example, the first conductive layer can include a first arm having a shape defined by a first outer border comprising a first conic section and a first inner border comprising a second conic section, a feed line coupled to the first arm at a feedpoint location at or near a central axis of the first arm, and a second arm offset from the first arm along the central axis of the first arm, the second arm defined by a shape at least in part mirroring a shape of the first arm.

16 Claims, 5 Drawing Sheets

BALANCED DUAL-BAND EMBEDDED ANTENNA

BACKGROUND

Information can be wirelessly transferred using electromagnetic waves. Generally, such electromagnetic waves are either transmitted or received using a specified range of frequencies, such as established by a spectrum allocation authority for a particular location where a wireless device or assembly will be used or manufactured. Such wireless devices or assemblies generally include one or more antennas, and each antenna can be configured for transfer of information at a particular range of frequencies. Such ranges of frequencies can include frequencies used by wireless digital data networking technologies. Such technologies can use, conform to, or otherwise incorporate aspects of one or more other protocols or standards, such as for providing cellular telephone or data services, fixed or mobile terrestrial radio communications, satellite communications, or for other applications.

Overview

A wireless device can be configured to transfer information using different operating frequency ranges (e.g., bands). In generally-available devices, such information transfer can be performed using separate antennas designed to operate in respective frequency ranges. Such antennas can be assemblies separate from other communication circuitry, such as coupled to the communication circuitry using one or more cables or connectors. Manufacturing cost, complexity, or reliability can be negatively affected by use of such separate antennas. The present inventors have recognized, among other things, that a multi-band antenna can reduce or eliminate a need for separate antennas to provide coverage of different operating frequency ranges.

Also, antenna configurations can include balanced or unbalanced configurations. For example, a balanced antenna configuration can provide enhanced gain, substantially-omnidirectional response in at least one plane, and reduced radiation pattern sensitivity and reduced input impedance fluctuation in response to changing surroundings, as compared to single-ended antenna configurations, but at a cost of larger dimensions or additional interface circuitry as compared to various unbalanced antenna configurations.

For example, generally-available communication circuits generally provide an electrically unbalanced communication port for coupling communication signals between an antenna and the communication circuit. In applications where a balanced antenna is desired, a balun can be used to couple and match the balanced antenna to an unbalanced source. A discrete balun, such as included as a portion of a communication circuit, can increase cost and consume substantial volume. Such costs and complexity can increase further in multi-band applications where multiple antennas or baluns may be needed.

The present inventor has recognized, among other things, that a balanced antenna configuration can be formed as a portion of a printed circuit board (PCB) assembly (e.g., the planar antenna can be "embedded" in the PCB design rather than including a separate antenna assembly). The present inventor has also recognized that such a balanced antenna configuration can include a distributed balun as a portion of one or more conductive layers included in the PCB assembly. The present inventor has also recognized that wideband operation, in multiple frequency ranges, can be provided by dual-band scaling of a length of a transmission line configured as an impedance matching transformer, and using a balanced antenna configuration having at least two planar arms including a shape defined at least in part using a conic section.

A planar antenna, such as included as a portion of a printed circuit board (PCB) assembly, can include a dielectric layer and a first conductive layer mechanically coupled to the dielectric layer. In an example, the first conductive layer can include a first arm having a shape defined by a first outer border comprising a first conic section and a first inner border comprising a second conic section, a feed line coupled to the first arm at a feedpoint location at or near a central axis of the first arm, and a second arm offset from the first arm along the central axis of the first arm, the second arm defined by a shape at least in part mirroring a shape of the first arm.

In an example, the planar antenna can include a second conductive layer mechanically coupled to the dielectric layer, the second conductive layer comprising a first conductor including a footprint substantially the same as the first arm and conductively coupled through one or more conductive vias through the dielectric layer to the first arm, and a second conductor conductively isolated from the first conductor and including a footprint substantially the same as the second arm and conductively coupled through one or more conductive vias through the dielectric layer to the second arm.

This overview is intended to provide an overview of subject matter of the present patent application. It is not intended to provide an exclusive or exhaustive explanation of the invention. The detailed description is included to provide further information about the present patent application.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Figure 1:
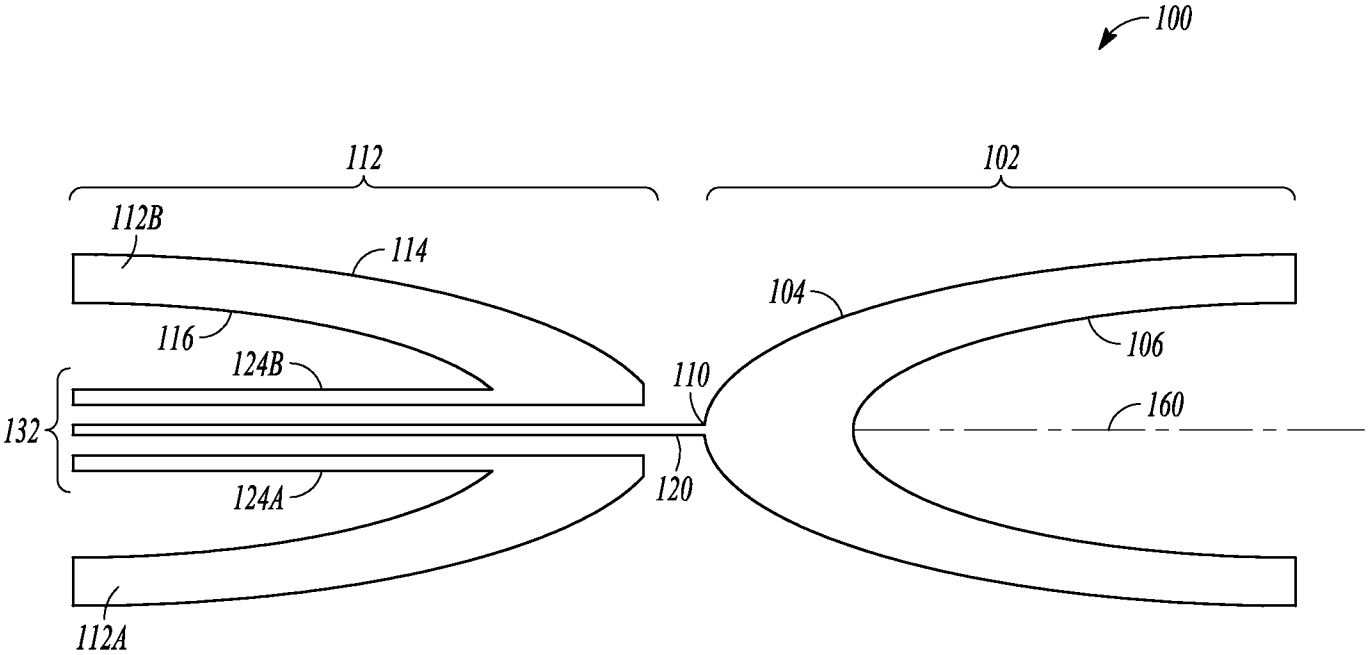
FIG. 1 illustrates generally an example of a single frequency band planar antenna comprising a conductive layer, such as a portion of a PCB assembly.

FIG. 1 illustrates generally an example of a planar antenna, such as a single-band antenna, that can include a conductive layer 100, such as a portion of a PCB assembly. In an example, the conductive layer 100 can include a first arm 102, such as defined by a shape having an outer border 104 defined at least in part by a first conic section and an inner border 106 defined at least in part by a second conic section. In an example, one or more of the first or second conic sections can include a parabola, an ellipse (or a portion of an ellipse), or a hyperbola. The first arm 102 can provide a single-ended wideband antenna, such as when coupled to a feed line 120. However, a single-ended wideband antenna is generally located near a return conductor plane, such as to provide a counterpoise to the first arm 102.

The present inventor has recognized, among other things, that such a return conductor (e.g., a counterpoise) can undesirably consume a significant surface area of a PCB assembly, and that such a single-ended antenna configuration can have a radiation pattern that is more sensitive to changes in the medium surrounding the antenna (e.g., nearby conductors, or materials having a significantly different dielectric constant than free space), as compared to a balanced antenna configuration. Accordingly, in the example of FIG. 1, a second arm 112 can be located laterally offset from the first arm 102, and can be coupled to a return conductor, such as using a lower portion 112A of the second arm 112, or an upper portion 112B of the second arm 112. Such a balanced configuration is not dependent on a return plane for operation, and can provide an omnidirectional response, such as in a plane orthogonal to the plane of the conductive layer 100. In an example, the second arm 112 can include an outer border 114 having a shape similar (or identical) to the outer border 104 of the first arm 102, such as including the first conic section, and an inner border 116 shaped similarly to the inner border 106. In an example, a feed line 120 can be coupled to the first arm 102 at a feedpoint location 110 along a central axis 160 of the first arm 102. In the example shown in FIG. 1, the feed line 120 bifurcates the second arm 112 along the central axis 160 of the planar antenna. However, in other examples, a feed line can be coupled to the antenna, such as at the feedpoint location 110, from one or more other directions. For example, a twin-axial feed can be used, such as including respective balanced conductors that can be electrically coupled to the first and second arms 102 and 112. Such a twin-axial feed can be coupled to a communication circuit such as via one or more of a discrete or distributed balun.

The conductive layer 100 can include one or more of copper, tungsten, silver, aluminum, steel, or one or more other materials, such as formed lithographically, stamped, cut, or otherwise fabricated to the provide the pattern or shape shown in the example of FIG. 1. A communication circuit can be coupled to the antenna, such as conductively or capacitively, such as in a region 132.

Figure 2A:
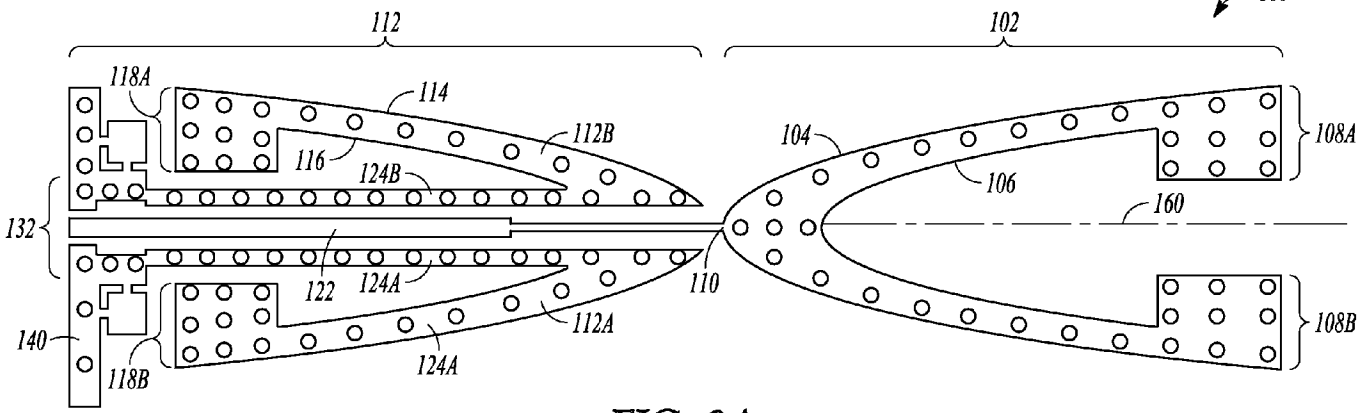
FIG. 2A illustrates generally an example of a first conductive layer of a PCB assembly that can include at least a portion of a dual-frequency band planar antenna.

FIG. 2A illustrates generally an example of a first conductive layer 100 of a PCB assembly that can include at least a portion of a dual-band planar antenna, such as similar to the example discussed above in relation to FIG. 1, and including features for dual-band or multi-band operation. The conductive layer 100 can include a copper layer, or can include one or more other conductive materials, such as deposited, etched (e.g., using a lithographic or other process), or otherwise formed and coupled to a dielectric layer. Such a dielectric layer can include a glass-epoxy laminate such as FR-4, or one or more other materials, such as generally used in PCB fabrication. Such materials can include a bismaleimide-triazine (BT) material, a cyanate ester, a polyimide material, or a polytetrafluoroethylene material, or one or more other materials.

For example, a flexible dielectric material (e.g., polyimide) can be used, and the planar antenna can be conformed or attached to a flat or curved shape, such as adhered, attached, or otherwise bonded to a surface (e.g., a radome or housing). In an example, a communication circuit can be provided on a rigid or flexible substrate, and one or more antennas can be formed on a flexible substrate attached to the communication circuit's substrate (e.g., a rigid-flex or flex-circuit configuration).

In an example such as shown in FIG. 2A, and similar to the examples discussed above with respect to FIG. 1, the first conductive layer 100 can include a first arm 102 comprising an outer border 104 defined at least in part by a shape including first conic section, and an inner border 106 defined at least in part by a shape including a second conic section. The first arm 102 can be laterally offset along a central axis 160 from a second arm 112. In an example, the second arm 112 can include an outer border 114 comprising a shape defined at least in part by the same (or a shape similar to) the first conic section, and an inner border 116 comprising a shaped defined at least in part by the same (or a shape similar to) the second conic section. A feed line 120 can be coupled to the first arm 102 at a feedpoint location 110. The feed line 120 can bifurcate the second arm 112 into a lower portion 112A and an upper portion 112B. The lower and upper portions 112A through 112B of the second arm 112 can be coupled to each other and to a reference conductor 104 (e.g., a ground plane that is laterally offset from the planar antenna) such as using a lower return conductor 124A and an upper return conductor 124B. In an example, the feed line 120, lower, and upper return conductors 124A through 124B can provide a coplanar waveguide (CPWG) structure.

In an example, an input impedance and balance of the planar antenna can be controlled at least in part using a length of the CPWG along the central axis 160 of the second arm 112, or using a width of the feed line 120. For example, in a first region of the feed line 120 nearby the feedpoint location 110, the feed line 120 can have a first specified width. In a second region 122 more distal to the feedpoint location 110, the feed line 122 can be wider. In this manner, an inductive and capacitive contributions of the feed line 120 can be adjusted to control an input impedance of the planar antenna. In an example, one or more of a spatial arrangement, size, or shape of one or more of the second arm 112, the return conductors 124A or 124B, or the feed line 120 are configured to provide a specified input impedance to a communication circuit coupled to the planar antenna.

A lateral width of the respective conductive strips comprising the first arm 102 and the second arm 112 need not be uniform along the planar antenna. For example, as shown in FIG. 2A, a lateral width of the respective conductive strips can be wider in a location near the feedpoint location 110, and can taper to become progressively more narrow in either direction away from the feedpoint location 110.

In an example, one or more of the first arm 102 or the second arm 112 can include respective fat tail portions distal to the feedpoint location n110, where a lateral width of respective conductive strips again widens, such as including a wider portion at a first distal tip region 108A or a second distal tip region 108B of the first arm 102, or a wider portion at a first distal tip region 118A or a second distal tip region 118B of the second arm 112. Such wider portions at such distal tip locations 108A through 108B or 118A through 118B can be used to provide capacitive coupling between upper and lower portions of respective arms of the planar antenna. Such wider portions can be used to adjust an antenna impedance or resonant frequency, along with adjusting a total length of the first and second arms 102 and 112. In an example, such wider portions can be used to adjust an input impedance or resonance to provide to or more specified ranges of operating frequencies, such as to provide a multi-band antenna as indicated in the simulations of the illustrative examples of FIGS. 3 and 4.

Figure 2B:
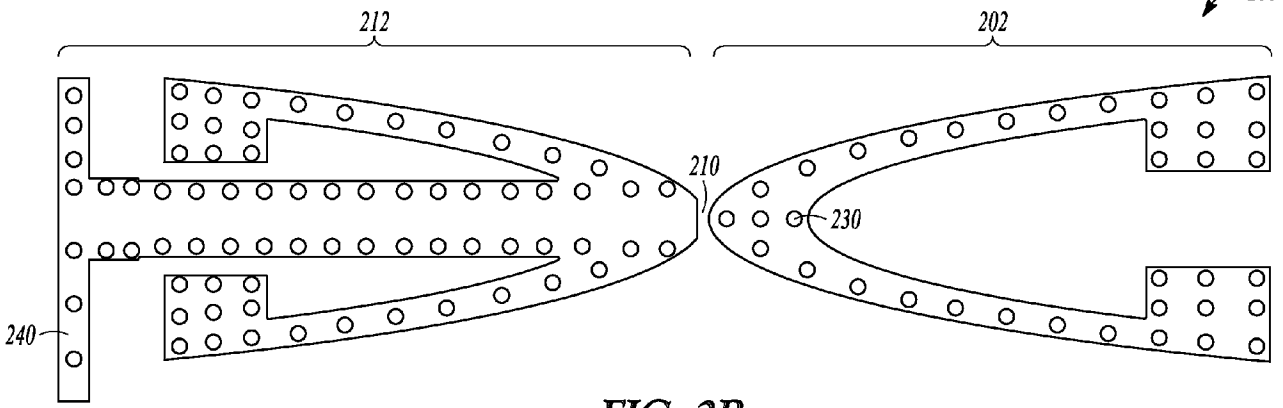
FIG. 2B illustrates generally an example of a second conductive layer of a PCB assembly that can include at least a portion of a dual-frequency band planar antenna.

FIG. 2B illustrates generally an example of a second conductive layer 200 of a PCB assembly that can include at least a portion of a dual-frequency band planar antenna, such as located in a layer above or below the conductive layer 100 of FIG. 2A. In an example, the second conductive layer 200 can include a first arm 202 or a second 212 having one or more of a shape, dimensions, or a footprint similar to portions of the respective first arm 102 or second arm 112 of the first conductive layer 100. The first and second arms 202 and 212 of the second conductive layer 200 can be separated by a gap 210.

In an example, the first conductive layer 100 of FIG. 2A and the second conductive layer 200 of FIG. 2B can be coupled to a dielectric layer, such as including a portion of a PCB assembly. For example, respective portions of the second conductive layer 200 can be conductively coupled to portions of the first conductive 100 using one or more vias (e.g., plated through holes or buried vias), such as through one or more dielectric layers of a PCB assembly.

Such a PCB assembly can include other circuitry or components, such as a wireless communication circuit. In an example, a PCB assembly can include a power plane or a ground plane (e.g., the reference conductor 140), and a region of the PCB assembly including the first and second conductive layers 100 and 200 can be offset from such a power plane or ground plane, or such planes can be removed in a region underneath or nearby a footprint of the first and second conductive layers. In an example, the central axis 160 of the planar antenna, including the first conductive layer 100, and the second conductive layer 200, can be oriented vertically, such as to provide a substantially uniform radiation (or receiving) pattern along a horizon in a plane perpendicular to the central axis.

As discussed above, a balanced antenna configuration is generally coupled to an unbalanced communication circuit port using an impedance transformation. In one approach, a discrete balun or transformer can be used to provide such an impedance transformation, but such a component can add cost, decrease reliability, or waste space, in comparison to other approaches. The present inventor has recognized, among other things, that a length of the first arm 112 and the second arm 212 can be about a quarter of a wavelength (or an odd multiple of quarter wavelengths) at a center frequency within a specified range of operating frequencies of the planar antenna. Such a wavelength can include an effective wavelength of propagation taking into account an effective relative dielectric constant incorporating a contribution from the dielectric constant of the dielectric material comprising the PCB assembly (or one or more other dielectric materials comprising or located nearby the CPWG).

The CPWG structure including the feed line 110, the lower and upper return conductors 124A through 124B, and the second arm 212 in the region under the CPWG, can properly match the balanced planar antenna configuration to a single-ended or unbalanced port of a wireless communication circuit, providing a distributed "balun." In an example, such as for a multi-band antenna, the feed line can include a lateral width that varies, such as to provide a first impedance transformation for a first range of operating frequencies using a quarter wavelength-long segment of the feed line 120, such as a wider portion as shown at the location 122, and using a remainder (or all of the feed line 120) to provide a second impedance transformation for a second range of operating frequencies.

In an example of a dual-band application, such as shown in FIGS. 2A and 2B, the CPWG structure can be about one eighth of an effective wavelength corresponding to an operating frequency of about 2.4 GHz, and about one quarter of an effective wavelength corresponding to an operating frequency of about 5.5 GHz. In this illustrative example, a distributed inductance and capacitance contribution from the CPWG structure can allow the planar antenna to be compressed in length along the central axis 160 as compared to a 2.44 GHz, free-space, balanced, half-wavelength dipole configuration, such as providing a total antenna length of about 55% of the corresponding 2.44 GHz half-wavelength dipole configuration. Such length compression can save surface area on a PCB assembly, such as while still providing at least one plane having a relatively uniform (e.g., omnidirectional) radiation pattern (e.g., in an orthogonal direction to the central axis 160 of the planar antenna). Such an omnidirectional response can be provided in each of the frequencies of operation, such as in this illustrative example at about 2.4 GHz and at about 5.5 GHz.

Figure 3:
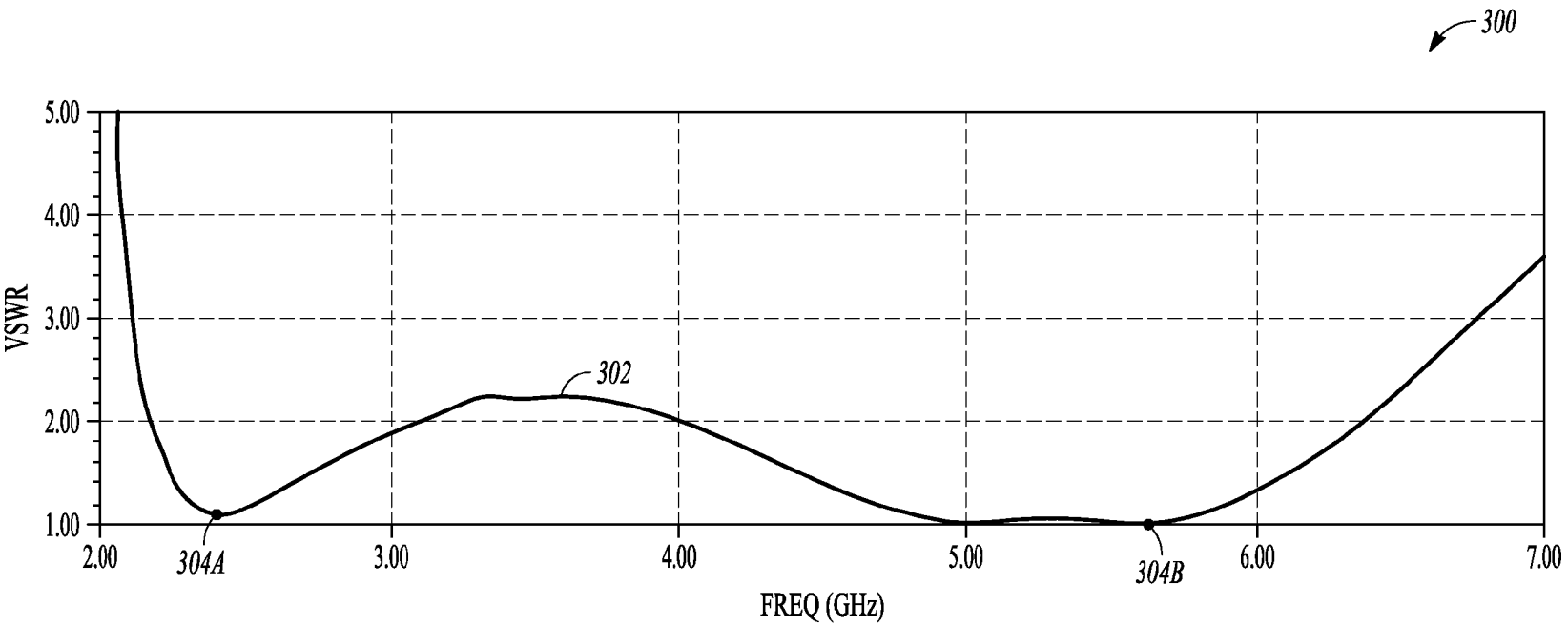
FIG. 3 illustrates generally an illustrative example of a voltage standing wave ratio (VSWR) simulated for the antenna configuration of FIGS. 2A through 2B.

FIG. 3 illustrates generally an illustrative example of a voltage standing wave ratio (VSWR) simulated for the antenna configuration of FIGS. 2A through 2B. A usable range of operating frequencies can be specified in terms of VSWR, or terms of a corresponding return loss, or using one or more other criteria. For example, a specified S11 parameter of about −6 dB or lower (e.g., a return loss of 6 dB), can be considered generally acceptable for a variety of applications, such as wireless control or data acquisition (e.g., "supervisory control and data acquisition" (SCADA)), or including one or more other applications. Such a return loss corresponds to a VSWR of 3:1 or less (e.g., about 3.01 or less as indicated in FIG. 3).

For example, the antenna configuration of FIGS. 2A through 2B simulated in the illustrative example of FIG. 3 would meet such a criterion in a frequency range from about 2.1 gigahertz (GHz) through about 6.8 GHz, with respective center frequencies (e.g., at or near a local or global VSWR minimum corresponding to one or more antenna resonances) for two ranges of operating frequencies at a first frequency 304A of about 2.4 GHz and a second frequency 304B of about 5.6 GHz. Such center frequencies are separated by more than an octave, and the usable operating frequency ranges can, but need not, overlap, depending on what performance criteria are used. For example, a criterion including VSWR of 2:1 or less, when applied to FIG. 3, would show two discrete, non-overlapping ranges of usable operating frequencies.

Figure 4:
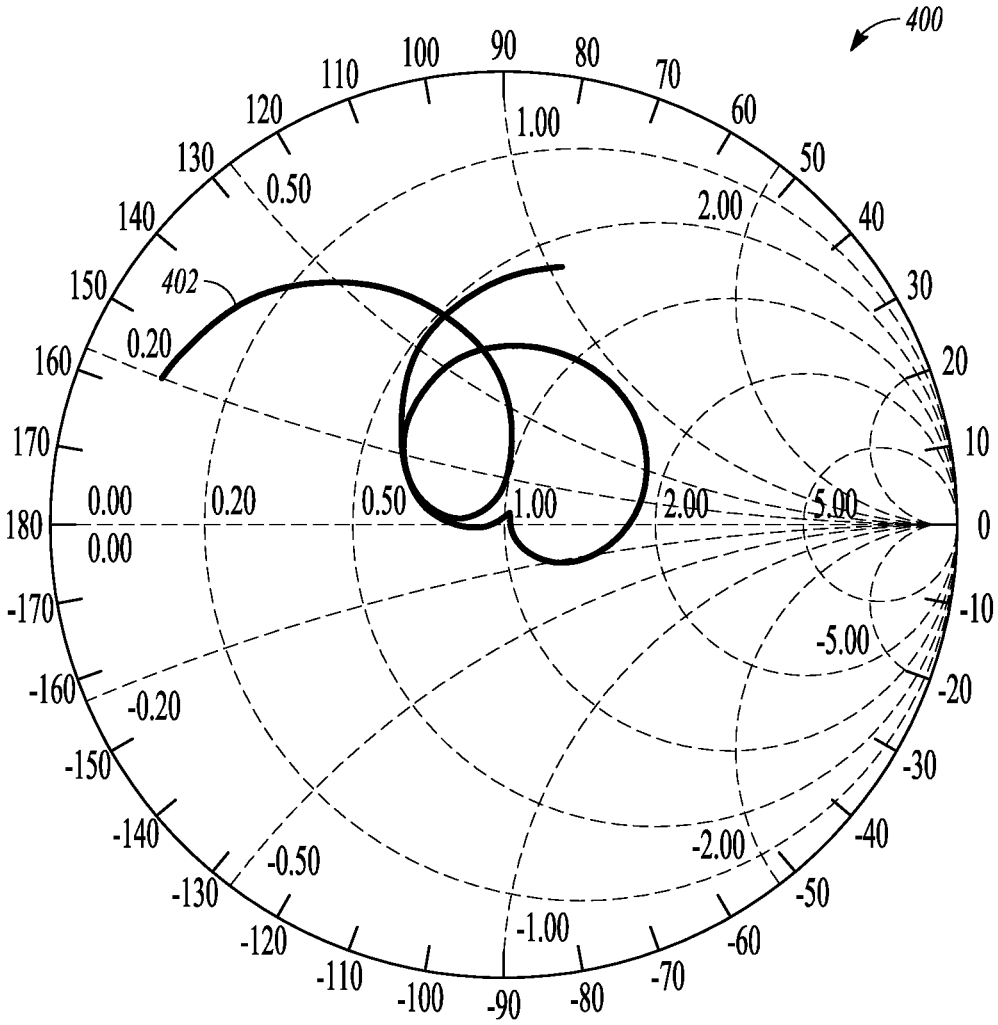
FIG. 4 illustrates generally an illustrative example of an impedance Smith Chart simulated for the dual-banded antenna configuration of FIGS. 2A through 2B.

FIG. 4 illustrates generally an illustrative example of an impedance Smith Chart simulated for the antenna configuration of FIGS. 2A through 2B. Loops in the impedance response can be provided by a multiply-resonant antenna structure. Two or more loops encircle the center or unit impedance of the chart (e.g., corresponding to a 50-ohm real impedance). As discussed above, the geometry of one or more conductive portions of the antenna can be adjusted, such as parametrically studied via simulation to achieve a desired input impedance range. In a case where the desired input impedance is not easily achieved, a matching structure such as one or more discrete or distributed matching components can be used to minimize or reduce the impedance discontinuity between the antenna and a wireless communication circuit coupled to the antenna via the matching structure, or to adjust the input impedance presented to the wireless communication circuit.

In an illustrative example, the antenna configuration of FIGS. 2A and 2B can be simulated, and accordingly to simulation can provide a substantially omnidirectional response in a plane orthogonal to the plane of one or more conductive layers of the antenna. For example, such an antenna can provide a peak gain of about 0.5 dB at 2.4 GHz, and about 3.5 dB at 5.5 GHz. According to such an illustrative example, the antenna configuration of FIGS. 2A and 2B can provide a radiation efficiency in excess of 90 percent at one or more of 2.4 GHz or 5.5 GHz.

In an example, two or more planar antennas such as including the conductive layers shown in FIGS. 2A and 2B can be included in a wireless communication system. For example, a first antenna can be operated using a first range of frequencies, and a second antenna can be operated using a second range of frequencies (e.g., a "frequency diversity" configuration), or two or more antennas can be operated to transmit simultaneously or one-at-a-time, such as separated by a specified distance. For example, the two or more antennas can be spatially separated by more than a half wavelength corresponding to the free-space wavelength of propagation at the center frequency being used (e.g., a "spatial diversity configuration").

Figure 5:
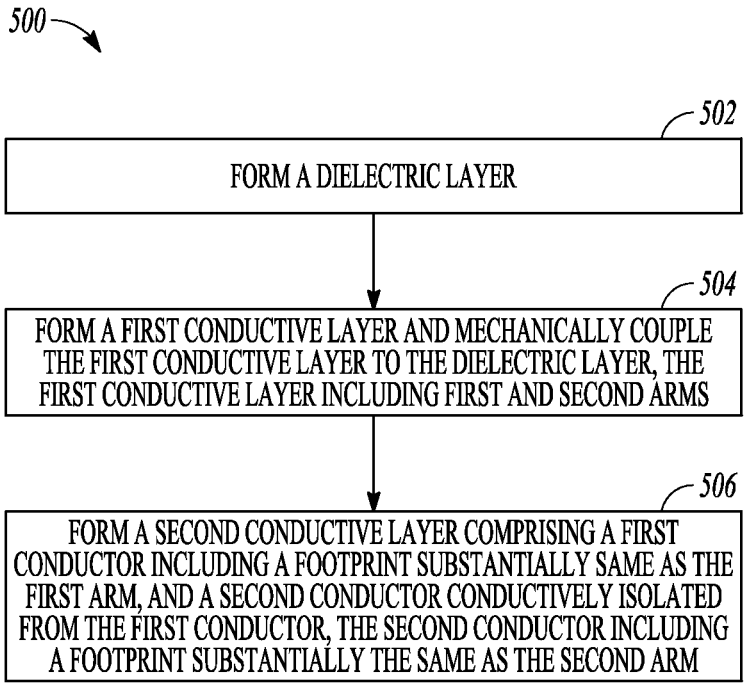
FIG. 5 illustrates generally a technique, such as a method, for forming a planar antenna such as described and shown in the examples of FIG. 1, 2A, 2B, 3, or 4.

FIG. 5 illustrates generally a technique 500, such as a method, for forming a planar antenna such as an antenna described and shown in the examples of FIG. 1, 2A, 2B, 3, or 4. At 502, a dielectric layer can be formed, such as including a dielectric material comprising one or more layers of a PCB assembly (e.g., a cured glass-epoxy layer, a partially-cured prepreg layer, or including one or more other materials). At 504 a first conductive layer can be formed and mechanically coupled to the dielectric layer.

In an example, forming the first conductive layer can include forming a first arm having a shape defined by a first outer border comprising a first conic section and a first inner border comprising a second conic section, forming a feed line coupled to the first arm at a feedpoint location at or near a central axis of the first arm, and forming a second arm offset from the first arm along the central axis of the first arm, the second arm defined by a shape at least in part mirroring a shape of the first arm. In an example, the forming the first conductive layer can include forming a return conductor.

In an example, at 506, a second conductive layer can be formed and mechanically coupled to the dielectric layer. In an example, forming the second conductive layer can include forming a first conductor including a footprint substantially the same as the first arm and conductively coupled through one or more conductive vias through the dielectric layer to the first arm, and forming a second conductor conductively isolated from the first conductor and including a footprint substantially the same as the second arm and conductively coupled through one or more conductive vias through the dielectric layer to the second arm.

VARIOUS NOTES & EXAMPLES

Example 1 can include subject matter (such as an apparatus, a method, a means for performing acts, or a machine readable medium including instructions that, when performed by the machine, that can cause the machine to perform acts), such as can include a planar antenna, comprising a dielectric layer, a first conductive layer mechanically coupled to the dielectric layer, the first conductive layer comprising a first arm having a shape defined by a first outer border comprising a first conic section and a first inner border comprising a second conic section, a feed line coupled to the first arm at a feedpoint location at or near a central axis of the first arm, and a second arm offset from the first arm along the central axis of the first arm, the second arm defined by a shape at least in part mirroring a shape of the first arm. In Example 1, at least a portion of the feed line can bifurcate the second arm into at least two portions, and the at least two portions of the second arm can be conductively coupled to a return conductor.

Example 2 can include, or can optionally be combined with the subject matter of Example 1, to optionally include a feed line located laterally between respective return conductors comprising the at least two portions of the second arm.

Example 3 can include, or can optionally be combined with the subject matter of Example 2, to optionally include a feed line including a first lateral width at a first location proximal to the first arm and a second lateral width at a second location distal to the first arm, the second location in a region where the feed line is located laterally between the respective return conductors.

Example 4 can include, or can optionally be combined with the subject matter of one or any combination of Examples 1 through 3 to optionally include first and second arms comprising respective conductive strips including a lateral width that varies along the central axis.

Example 5 can include, or can optionally be combined with the subject matter of one or any combination of Examples 1 through 4 to optionally include respective conductive strips including a lateral width tapering from a wider width near the feedpoint location to a narrower width away from the feedpoint location.

Example 6 can include, or can optionally be combined with the subject matter of Example 5, to optionally include respective conductive strips including a lateral width that widens again at respective distal tips of the conductive strips away from the feedpoint location.

Example 7 can include, or can optionally be combined with the subject matter of Example 6, to optionally include one or more of a length of the first and second arms along the central axis, or a separation between respective distal tips of the conductive strips, configured to provide at least two specified ranges of operating frequencies for wireless information transfer, the two specified ranges including respective center frequencies that are separated by at least an octave.

Example 8 can include, or can optionally be combined with the subject matter of one or any combination of Examples 1 through 7 to optionally include a total length of the first and second arms of about 1.3 inches, a first specified operating frequency range includes about 2.4 GHz, and a second specified operating frequency range includes about 5.5 GHz.

Example 9 can include, or can optionally be combined with the subject matter of one or any combination of Examples 1 through 8 to optionally include a second conductive layer mechanically coupled to the dielectric layer, the second conductive layer comprising a first conductor including a footprint substantially the same as the first arm and conductively coupled through one or more conductive vias through the dielectric layer to the first arm, and a second conductor conductively isolated from the first conductor and including a footprint substantially the same as the second arm and conductively coupled through one or more conductive vias through the dielectric layer to the second arm.

Example 10 can include, or can optionally be combined with the subject matter of Example 9, to optionally include one or more of the second arm, the return conductor, or the feed line comprising a balun configured to provide balanced excitation of the first and second arms in response to the feed line being driven by an unbalanced source.

Example 11 can include, or can optionally be combined with the subject matter of one or any combination of Examples 9 through 10 to optionally include one or more of a spatial arrangement, size, or shape of one or more of the second arm, the return conductor, or the feed line configured to provide a specified input impedance.

Example 12 can include subject matter (such as an apparatus, a method, a means for performing acts, or a machine readable medium including instructions that, when performed by the machine, that can cause the machine to perform acts), such as including a planar antenna, comprising a dielectric layer, a first conductive layer mechanically coupled to the dielectric layer, the first conductive layer comprising a first arm having a shape defined by a first outer border comprising a first conic section and a first inner border comprising a second conic section, a feed line coupled to the first arm at a feedpoint location at or near a central axis of the first arm, and a second arm offset from the first arm along the central axis of the first arm, the second arm defined by a shape at least in part mirroring a shape of the first arm. In Example 11, at least a portion of the feed line can bifurcate the second arm into at least two portions, the at least two portions of the second arm conductively coupled to a return conductor. In Example 11, the planar antenna can include a second conductive layer mechanically coupled to the dielectric layer, the second conductive layer comprising a first conductor including a footprint substantially the same as the first arm and conductively coupled through one or more conductive vias through the dielectric layer to the first arm and a second conductor conductively isolated from the first conductor and including a footprint substantially the same as the second arm and conductively coupled through one or more conductive vias through the dielectric layer to the second arm, the feed line located laterally between respective return conductors comprising the at least two portions of the second arm.

Example 13 can include, or can optionally be combined with the subject matter of one or any combination of Examples 1-12 to include, subject matter (such as an apparatus, a method, a means for performing acts, or a machine readable medium including instructions that, when performed by the machine, that can cause the machine to perform acts), such as forming a dielectric layer, forming a first conductive layer mechanically coupled to the dielectric layer, the forming the first conductive layer comprising forming a first arm having a shape defined by a first outer border comprising a first conic section and a first inner border comprising a second conic section, forming a feed line coupled to the first arm at a feedpoint location at or near a central axis of the first arm, forming a second arm offset from the first arm along the central axis of the first arm, the second arm defined by a shape at least in part mirroring a shape of the first arm, and forming a return conductor, at least a portion of the feed line bifurcating the second arm into at least two portions, and the at least two portions of the second arm conductively coupled to the return conductor.

Example 14 can include, or can optionally be combined with the subject matter of Example 13, to optionally include forming the feed line including laterally locating the feed line between respective return conductors comprising the at least two portions of the second arm.

Example 15 can include, or can optionally be combined with the subject matter of one or any combination of Examples 13 through 14 to optionally include a feed line comprising a first lateral width at a first location proximal to the first arm and a second lateral width at a second location distal to the first arm; and the second location in a region where the feed line is located laterally between the respective return conductors.

Example 16 can include, or can optionally be combined with the subject matter of one or any combination of Examples 13 through 15 to optionally include first and second arms comprising respective conductive strips including a lateral width that varies along the central axis.

Example 17 can include, or can optionally be combined with the subject matter of Example 16, to optionally include respective conductive strips including a lateral width tapering from a wider width near the feedpoint location to a narrower width away from the feedpoint location.

Example 18 can include, or can optionally be combined with the subject matter of Example 17, to optionally include respective conductive strips including a lateral width that widens again at respective distal tips of the conductive strips away from the feedpoint location.

Example 19 can include, or can optionally be combined with the subject matter of Example 18, to optionally include one or more of a total length of the first and second arms along the central axis, or a separation between respective distal tips of the conductive strips, configured to provide at least two specified ranges of operating frequencies for wireless information transfer, the two specified ranges including respective center frequencies that are separated by at least an octave.

Example 20 can include, or can optionally be combined with the subject matter of one or any combination of Examples 13 through 19 to optionally include forming a second conductive layer mechanically coupled to the dielectric layer, the forming the second conductive layer comprising forming a first conductor including a footprint substantially the same as the first arm and conductively coupled through one or more conductive vias through the dielectric layer to the first arm, and forming a second conductor conductively isolated from the first conductor and including a footprint substantially the same as the second arm and conductively coupled through one or more conductive vias through the dielectric layer to the second arm.

Example 21 can include, or can optionally be combined with the subject matter of Example 20, to optionally include one or more of forming the second arm, forming the return conductor, or forming the feed line comprising forming a balun configured to provide balanced excitation of the first and second arms in response to the feed line being driven by an unbalanced source.

Example 22 can include, or can optionally be combined with the subject matter of one or any combination of Examples 13 through 21 to optionally include one or more of forming the second arm, forming the return conductor, or forming the feed line comprising providing a specified input impedance using one or more of a spatial arrangement, size, or shape of one or more of the second arm, the return conductor, or the feed line.

Example 23 can include, or can optionally be combined with any portion or combination of any portions of any one or more of Examples 1-22 to include, subject matter that can include means for performing any one or more of the functions of Examples 1-22, or a machine-readable medium including instructions that, when performed by a machine, cause the machine to perform any one or more of the functions of Examples 1-22.

Each of these non-limiting examples can stand on its own, or can be combined in any permutation or combination with any one or more of the other examples.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

Method examples described herein can be machine or computer-implemented at least in part. Some examples can include a computer-readable medium or machine-readable medium encoded with instructions operable to configure an electronic device to perform methods as described in the above examples. An implementation of such methods can include code, such as microcode, assembly language code, a higher-level language code, or the like. Such code can include computer readable instructions for performing various methods. The code may form portions of computer program products. Further, in an example, the code can be tangibly stored on one or more volatile, non-transitory, or non-volatile tangible computer-readable media, such as during execution or at other times. Examples of these tangible computer-readable media can include, but are not limited to, hard disks, removable magnetic disks, removable optical disks (e.g., compact disks and digital video disks), magnetic cassettes, memory cards or sticks, random access memories (RAMs), read only memories (ROMs), and the like.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. §1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

The claimed invention is:

1. A planar antenna, comprising:

a dielectric layer; and a first conductive layer mechanically coupled to the dielectric layer, the first conductive layer comprising:

a first arm having a shape defined by a first outer border comprising a first conic section and a first inner border comprising a second conic section;

a feed line coupled to the first arm at a feedpoint location at or near a central axis of the first arm; and a second arm offset from the first arm along the central axis of the first arm, the second arm defined by a shape at least in part mirroring a shape of the first arm; and wherein at least a portion of the feed line bifurcates the second arm into at least two portions;

wherein the at least two portions of the second arm are conductively coupled to a return conductor;

wherein the first and second arms comprise respective conductive strips including a lateral width that varies along the central axis;

wherein the respective conductive strips include a lateral width tapering from a wider width near the feedpoint location to a narrower width away from the feedpoint location; and wherein the respective conductive strips include a lateral width that widens again at respective distal tips of the conductive strips away from the feedpoint location.

2. The planar antenna of claim 1, wherein the feed line is located laterally between respective return conductors comprising the at least two portions of the second arm.

3. The planar antenna of claim 2, wherein the feed line includes a first lateral width at a first location proximal to the first arm and a second lateral width at a second location distal to the first arm; and wherein the second location is in a region where the feed line is located laterally between the respective return conductors.

4. The planar antenna of claim 1, wherein one or more of a length of the first and second arms along the central axis, or a separation between respective distal tips of the conductive strips, is configured to provide at least two specified ranges of operating frequencies for wireless information transfer, the two specified ranges including respective center frequencies that are separated by at least an octave.

5. The planar antenna of claim 4, wherein a total length of the first and second arms is about 1.3 inches, wherein a first specified operating frequency range includes about 2.4 GHz, and wherein a second specified operating frequency range includes about 5.5 GHz.

6. The planar antenna of claim 1, comprising a second conductive layer mechanically coupled to the dielectric layer, the second conductive layer comprising:

a first conductor including a footprint substantially the same as the first arm and conductively coupled through one or more conductive vias through the dielectric layer to the first arm; and a second conductor conductively isolated from the first conductor and including a footprint substantially the same as the second arm and conductively coupled through one or more conductive vias through the dielectric layer to the second arm.

7. The planar antenna of claim 6, wherein one or more of the second arm, the return conductor, or the feed line comprises a balun configured to provide balanced excitation of the first and second arms in response to the feed line being driven by an unbalanced source.

8. The planar antenna of claim 6, wherein one or more of a spatial arrangement, size, or shape of one or more of the second arm, the return conductor, or the feed line is configured to provide a specified input impedance.

9. A planar antenna, comprising:

a dielectric layer; and a first conductive layer mechanically coupled to the dielectric layer, the first conductive layer comprising:

a first arm having a shape defined by a first outer border comprising a first conic section and a first inner border comprising a second conic section;

a feed line coupled to the first arm at a feedpoint location at or near a central axis of the first arm; and a second arm offset from the first arm along the central axis of the first arm, the second arm defined by a shape at least in part mirroring a shape of the first arm; and wherein at least a portion of the feed line bifurcates the second arm into at least two portions; and wherein the at least two portions of the second arm are conductively coupled to a return conductor;

wherein the first and second arms comprise respective conductive strips including a lateral width that varies along the central axis;

wherein the respective conductive strips include a lateral width tapering from a wider width near the feedpoint location to a narrower width away from the feedpoint location; and wherein the respective conductive strips include a lateral width that widens again at respective distal tips of the conductive strips away from the feedpoint location; and a second conductive layer mechanically coupled to the dielectric layer, the second conductive layer comprising:

a first conductor including a footprint substantially the same as the first arm and conductively coupled through one or more conductive vias through the dielectric layer to the first arm; and a second conductor conductively isolated from the first conductor and including a footprint substantially the same as the second arm and conductively coupled through one or more conductive vias through the dielectric layer to the second arm; and wherein the feed line is located laterally between respective return conductors comprising the at least two portions of the second arm.

10. A method for providing a planar antenna, comprising forming a dielectric layer; and forming a first conductive layer mechanically coupled to the dielectric layer, the forming the first conductive layer comprising:

forming a first arm having a shape defined by a first outer border comprising a first conic section and a first inner border comprising a second conic section;

forming a feed line coupled to the first arm at a feedpoint location at or near a central axis of the first arm; and forming a second arm offset from the first arm along the central axis of the first arm, the second arm defined by a shape at least in part mirroring a shape of the first arm; and forming a return conductor; and wherein at least a portion of the feed line bifurcates the second arm into at least two portions; and wherein the at least two portions of the second arm are conductively coupled to the return conductor;

wherein the first and second arms comprise respective conductive strips including a lateral width that varies along the central axis;

wherein the respective conductive strips include a lateral width tapering from a wider width near the feedpoint location to a narrower width away from the feedpoint location; and wherein the respective conductive strips include a lateral width that widens again at respective distal tips of the conductive strips away from the feedpoint location.

11. The method of claim 10, wherein forming the feed line includes laterally locating the feed line between respective return conductors comprising the at least two portions of the second arm.

12. The method of claim 11, wherein the feed line includes a first lateral width at a first location proximal to the first arm and a second lateral width at a second location distal to the first arm; and wherein the second location is in a region where the feed line is located laterally between the respective return conductors.

13. The method of claim 10, wherein one or more of a total length of the first and second arms along the central axis, or a separation between respective distal tips of the conductive strips, is configured to provide at least two specified ranges of operating frequencies for wireless information transfer, the two specified ranges including respective center frequencies that are separated by at least an octave.

14. The method of claim 10, comprising forming a second conductive layer mechanically coupled to the dielectric layer, the forming the second conductive layer comprising:

forming a first conductor including a footprint substantially the same as the first arm and conductively coupled through one or more conductive vias through the dielectric layer to the first arm; and forming a second conductor conductively isolated from the first conductor and including a footprint substantially the same as the second arm and conductively coupled through one or more conductive vias through the dielectric layer to the second arm.

15. The method of claim 14, wherein one or more of forming the second arm, forming the return conductor, or forming the feed line comprise forming a balun configured to provide balanced excitation of the first and second arms in response to the feed line being driven by an unbalanced source.

16. The method of claim 14, wherein one or more of forming the second arm, forming the return conductor, or forming the feed line comprises providing a specified input impedance using one or more of a spatial arrangement, size, or shape of one or more of the second arm, the return conductor, or the feed line.

* * * * *